US008469097B2

(12) United States Patent
Cochran et al.

(10) Patent No.: US 8,469,097 B2
(45) Date of Patent: Jun. 25, 2013

(54) SUBTERRANEAN TUBULAR CUTTER WITH DEPTH OF CUT FEATURE

(75) Inventors: Travis E. Cochran, Houston, TX (US); Steven R. Hayter, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 536 days.

(21) Appl. No.: 12/465,777

(22) Filed: May 14, 2009

(65) Prior Publication Data

US 2010/0288491 A1 Nov. 18, 2010

(51) Int. Cl.

| | |
|---|---|
| ***E21B 29/00*** | (2006.01) |
| ***E21B 43/11*** | (2006.01) |
| ***E21B 10/32*** | (2006.01) |

(52) U.S. Cl.

USPC ..... 166/298; 166/55.7; 175/292; 30/134; 30/188

(58) Field of Classification Search

USPC .... 30/92, 95, 99, 101, 134, 180, 188; 83/169, 83/456, 636, 697, 745; 166/55.7, 55.8, 117.6, 166/55.1, 325.1; 175/292

See application file for complete search history.

(56) References Cited

U.S. PATENT DOCUMENTS

| | | | | |
|---|---|---|---|---|
| 1,485,642 | A | 3/1924 | Stone | |
| 2,136,518 | A | 11/1938 | Nixon | |
| 2,167,739 | A | 8/1939 | Beck | |
| 2,353,284 | A * | 7/1944 | Barrett | 166/55.8 |
| 2,482,674 | A * | 9/1949 | Kriegel | 166/55.8 |
| 2,735,485 | A * | 2/1956 | Metcalf, Jr. | 166/55.8 |
| 2,888,806 | A * | 6/1959 | Teumer | 60/403 |
| 3,516,491 | A * | 6/1970 | Lewis | 166/336 |
| 4,132,270 | A | 1/1979 | Holland | |
| 4,582,134 | A * | 4/1986 | Gano et al. | 166/120 |
| 4,776,394 | A * | 10/1988 | Lynde et al. | 166/55.8 |
| 4,809,793 | A * | 3/1989 | Hailey | 175/265 |
| 4,887,668 | A * | 12/1989 | Lynde et al. | 166/55.8 |
| 4,995,466 | A * | 2/1991 | Snow, Jr. | 175/61 |
| 5,014,780 | A | 5/1991 | Skipper | |
| 5,018,580 | A | 5/1991 | Skipper | |
| 5,036,921 | A * | 8/1991 | Pittard et al. | 166/298 |
| 5,123,489 | A | 6/1992 | Davis et al. | |
| 5,150,755 | A * | 9/1992 | Cassel et al. | 166/297 |
| 5,242,017 | A * | 9/1993 | Hailey | 166/55.8 |
| 5,265,675 | A * | 11/1993 | Hearn et al. | 166/297 |

(Continued)

OTHER PUBLICATIONS

Guimaraes, Zacarais, et al., "Engineering Development to Improve Tubular Cutting Ability in High-Ductility Metallurgy Strings with Low-Torque Motors", SPE 121671, Mar. 2009, 1-13.

(Continued)

*Primary Examiner* — Jennifer H Gay
(74) *Attorney, Agent, or Firm* — Steve Rosenblatt

(57) ABSTRACT

A tubular cutter that cuts with extendable and rotating blades has its depth of cut limited upon getting through the tubular to be cut. In a preferred embodiment, the tubular has a loosely mounted member exterior thereto to be engaged by the rotating cutters. When such engagement happens the effect is that the loosely mounted member serves as a cover to the cutters to prevent them from cutting other structures beyond the tubular to be cut. The loosely mounted member is grabbed by the rotating blades for tandem rotation this preventing further cutting action. The load on the mill drops noticeably so that surface personnel have a signal to stop hydraulic pressure to the drive mechanism to allow the blades to retract and the cutter to be removed.

20 Claims, 1 Drawing Sheet

U.S. PATENT DOCUMENTS

| | | | | |
|---|---|---|---|---|
| 5,297,630 | A * | 3/1994 | Lynde et al. | 166/297 |
| 5,297,638 | A * | 3/1994 | Dolence, Jr. | 175/61 |
| 5,373,900 | A * | 12/1994 | Lynde et al. | 166/297 |
| 5,385,205 | A * | 1/1995 | Hailey | 166/55.8 |
| 5,456,312 | A * | 10/1995 | Lynde et al. | 166/55.6 |
| 5,458,208 | A * | 10/1995 | Clarke | 175/45 |
| 5,720,343 | A * | 2/1998 | Kilgore et al. | 166/120 |
| 5,788,000 | A * | 8/1998 | Maury et al. | 175/325.1 |
| 5,791,409 | A * | 8/1998 | Flanders | 166/55.8 |
| 5,829,518 | A | 11/1998 | Gano et al. | |
| 5,833,018 | A * | 11/1998 | von Gynz-Rekowski | 175/325.3 |
| 5,899,268 | A * | 5/1999 | Lynde et al. | 166/55.6 |
| 6,125,929 | A * | 10/2000 | Davis et al. | 166/55.7 |
| 6,276,452 | B1 | 8/2001 | Davis et al. | |
| 6,536,532 | B2 * | 3/2003 | Doane | 166/387 |
| 6,702,031 | B2 * | 3/2004 | Doane et al. | 166/382 |
| 6,739,415 | B2 * | 5/2004 | Mitchell et al. | 175/325.5 |
| 7,036,611 | B2 | 5/2006 | Radford et al. | |
| 7,063,155 | B2 * | 6/2006 | Ruttley | 166/298 |
| 7,134,504 | B2 * | 11/2006 | Doane et al. | 166/387 |
| 7,308,937 | B2 | 12/2007 | Radford et al. | |
| 7,325,612 | B2 * | 2/2008 | Hendrickson et al. | 166/298 |
| 7,412,761 | B2 * | 8/2008 | Male et al. | 29/458 |
| 7,467,661 | B2 * | 12/2008 | Gordon et al. | 166/298 |
| 7,661,470 | B2 * | 2/2010 | Doane et al. | 166/120 |
| 7,766,086 | B2 * | 8/2010 | Mondelli et al. | 166/374 |
| 7,823,632 | B2 | 11/2010 | McAfee et al. | |
| 2001/0020530 | A1 * | 9/2001 | Eaton | 166/241.6 |
| 2001/0032722 | A1 * | 10/2001 | Eaton | 166/241.4 |
| 2002/0038727 | A1 * | 4/2002 | Moore et al. | 175/325.5 |
| 2002/0117337 | A1 * | 8/2002 | Moore et al. | 175/324 |
| 2004/0188147 | A1 * | 9/2004 | Mitchell et al. | 175/325.3 |
| 2004/0251027 | A1 * | 12/2004 | Sonnier et al. | 166/297 |
| 2005/0034876 | A1 * | 2/2005 | Doane et al. | 166/386 |
| 2005/0077046 | A1 * | 4/2005 | Simpson et al. | 166/298 |
| 2005/0116469 | A1 * | 6/2005 | Parker | 285/354 |
| 2005/0133224 | A1 * | 6/2005 | Ruttley | 166/298 |
| 2005/0178558 | A1 * | 8/2005 | Kolle et al. | 166/373 |
| 2005/0224226 | A1 * | 10/2005 | Read, Jr. | 166/217 |
| 2006/0048950 | A1 * | 3/2006 | Dybevik et al. | 166/387 |
| 2006/0075889 | A1 * | 4/2006 | Walker | 89/1.15 |
| 2006/0137877 | A1 | 6/2006 | Watson et al. | |
| 2006/0196036 | A1 * | 9/2006 | Male et al. | 29/527.1 |
| 2006/0243445 | A1 * | 11/2006 | Hendrickson et al. | 166/298 |
| 2009/0050310 | A1 * | 2/2009 | McKay | 166/55.7 |
| 2009/0321063 | A1 * | 12/2009 | Bryant et al. | 166/55.1 |
| 2010/0038080 | A1 * | 2/2010 | McAfee et al. | 166/255.1 |
| 2010/0051292 | A1 * | 3/2010 | Trinh et al. | 166/378 |
| 2010/0089583 | A1 * | 4/2010 | Xu et al. | 166/298 |
| 2010/0288491 | A1 * | 11/2010 | Cochran et al. | 166/250.01 |

OTHER PUBLICATIONS

Portman, L.N., et al., "28% Chrome, 32% Nickel: A Case History on the Downhole Cutting of Exotic Completions", SPE 99917, Apr. 2006, 1-5.

Fitzgerald, A., et al., "New High-Performance Completion Packer Selection and Deployment for Holstein and Mad Dog Deepwater Gulf of Mexico Projects", SPE 95728, Oct. 2005, 1-20.

* cited by examiner

SUBTERRANEAN TUBULAR CUTTER WITH DEPTH OF CUT FEATURE

FIELD OF THE INVENTION

The field of the invention is tubular cutters for subterranean use and more particularly cutters with a feature associated with them to limit depth of cut.

BACKGROUND OF THE INVENTION

In some instances the tubular string downhole has to be cut such as when a tool is stuck and needs to be fished out. Other tools, like packers, have thin portions that are designed to be cut as the manner for release. When the mandrel is cut and compromised, the set force that holds the slips engaged to the tubular wall is released to allow the slips to retract so that the packer can be removed. Regardless of what type of tubular structure is being cut there is a reason to be concerned about the depth of cut since there are often structures in close proximity to the tubular being cut that could be damaged if the cutting went out radially too far.

Cutting devices such as underreamers are frequently used to cut downhole tubulars. They feature a plurality of arms that are radially extendable with cutting structure on the arms. A hydraulic motor turns the arms to cut the tubular. Surface personnel look at the pressure to the motor and look for a rapid change marking the removal of load as the tubular in question is cut all the way through. However, in many cases, the underreamer when getting through the tubular that it was cutting continues to turn and go to its outward maximum dimension. While surface personnel may detect a pressure change in the hydraulic drive system there can still be further damage done downhole before they can respond to such a change and shut the surface pumps off to retract the blades of the underreamer. The present invention addresses a way to avoid damage to surrounding structures that can be damaged by too deep a cut by an underreamer or some other rotary cutting tool. In essence, the cutter is prevented from further cutting once it extends to a predetermined dimension. In the preferred embodiment, a loose fitting sleeve is placed behind the tubular wall to be cut. Once the wall is through the spinning blades engage the rotating sleeve as cutting action stops. Instead the underreamer or cutter simply spins the sleeve and exhibits a low or no load hydraulic condition on the drive motor giving surface personnel a clue that the tubular has been cut through and that the tool can be retracted and removed without damage to structures beyond the rotating sleeve.

Underreamers with a device to absorb the initial impact of contact with the tubular to be cut and to control the cutting rate and amount of cutter contact by being rubbed down or off are illustrated as item 37 in U.S. Pat. No. 7,036,611. Also relevant to this art are U.S. Pat. Nos. 7,308,937 and 6,702,031.

Those skilled in the art will have a better understanding of the invention from the detailed description and associated drawings that appear below with the understanding that the full scope of the invention is given by the literal and equivalent scope of the appended claims.

SUMMARY OF THE INVENTION

A tubular cutter that cuts with extendable and rotating blades has its depth of cut limited upon getting through the tubular to be cut. In a preferred embodiment, the tubular has a loosely mounted member exterior thereto to be engaged by the rotating cutters. When such engagement happens the effect is that the loosely mounted member serves as a cover to the cutters to prevent them from cutting other structures beyond the tubular to be cut. The loosely mounted member is grabbed by the rotating blades for tandem rotation this preventing further cutting action. The load on the mill drops noticeably so that surface personnel have a signal to stop hydraulic pressure to the drive mechanism to allow the blades to retract and the cutter to be removed. While a physical gap gives some time to surface personnel to react before damage is done, the loosely mounted member not only gives more reaction time but further insures that the the structures beyond the tubular will not be cut.

DETAILED DESCRIPTION OF THE PREFERRED EMBODIMENT

Figure 1:
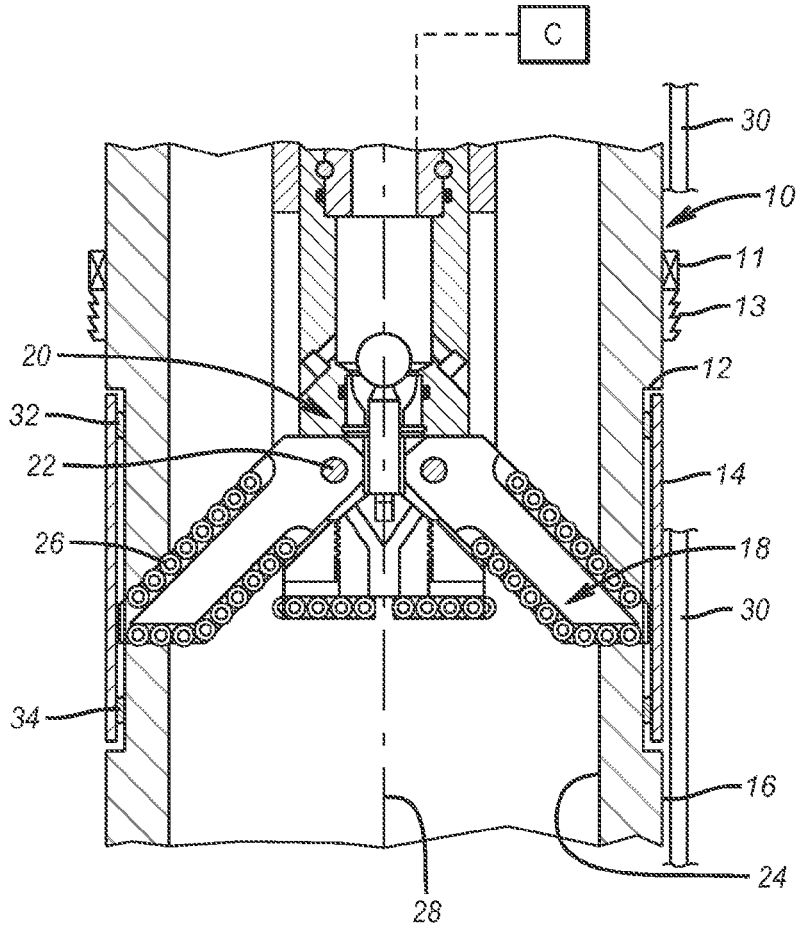
FIG. 1 illustrates an underreamer in the position where the tubular is cut through showing how a sleeve prevents further cutting
Figure 2:
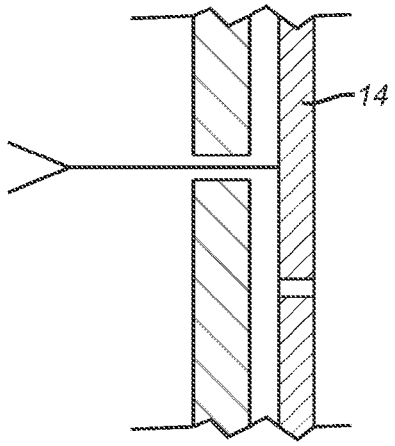
FIG. 2 is an alternative embodiment using schematically illustrated fluid cutting.
Figure 3:
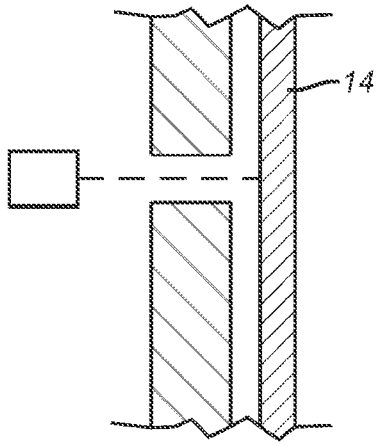
FIG. 3 is an alternative embodiment using schematically illustrated laser cutting.

Referring to FIG. 1 it can be seen that 10 is the tubular to be cut. Tubular 10 can be a part of a packer mandrel that has a sealing element 11 and slips 13 (shown schematically in FIG. 1) where the slips 13 release their grip from a set position when the mandrel is cut through, as one example. It can have an exterior recess 12 that supports a sleeve 14. Various threaded connections that make it possible to dispose a sleeve 14 in the vicinity of the outer surface 16 of the tubular 10 are omitted but those skilled in the art will appreciate that various ways of securing a member for rotatable movement (whether initially secured such as by a shear pin that breaks (not shown) or initially loosely mounted) when contacted by a cutter blade 18 of underreamer 20 that is of a known design. While cutter blade 18 is depicted as a mechanical cutter it is intended to be schematic and representative of other types of cutters both stationary and movable including but not limited to turning discs, fluid jets, shown in FIG. 2, lasers, shown in FIG. 3, or other energy emitting source. Many types of rotary cutters can be used that are all known in the art. In many cases the cutters have a plurality of blades such as 18 pivotally supported at pins 22 to swing out radially into contact with inner wall 24 to start the cutting. The blades can have inserts or hardened carbide or diamonds all shown schematically as 26 arrayed on the periphery around the edge of the blade. The blades are hydraulically actuated in the radial direction to contact surface 24 and can be rotated on axis 28 by a hydraulic motor or by string rotation from surface or by other known means to get the cutting accomplished.

In the embodiment in the FIGURE the cutting continues with blades 18 moving further out radially until the groove 12 is reached or the wall of tubing 10 is breached. After that the blades get a bite on sleeve 14 and sleeve 14 and the blades 18 start rotating in tandem. Further cutting cannot take place since in essence the sleeve 14 is a blunt cover on the sharp cutters 26 on the blades 18. Since the cutting action stops when the sleeve 14 is spun, other structures such as control line 30 are protected from the cutting blades 18. Surface personnel will detect a load drop-off when cutting action stops and turn off the fluid power which will retract blades 18 and stop them from further spinning. Any structures outside the sleeve 14 will not be severed by the cutter or underreamer 20.

The sleeve 14 can be seamless or it can have a seam or it can be a scroll with overlapping ends. It needs to be rigid enough to start spinning rather than buckling at the contact location for the blades 18 after they get through the tubular 10. The sleeve is preferably solid but can have openings of various sizes, shown in FIG. 2, and shapes and on a variety of patterns. The sleeve can optionally be on bearings 32 and 34 of various types and the space 36 between the bearings 32 and 34 can be filled with a lubricant such as grease or heavy gear oil. The bearings 32 and 34 can be made of a lubricious material and adhered to the sleeve 14 or the tubular 10.

One example can be Teflon®.

As another option but less effective is to use the exterior groove 12 without a sleeve 14 and hope that surface personnel notice the fall in pressure fast enough before the blades 18 extend further out and rip up external structures such as control line 30. To improve on this bare bones approach a controller C shown schematically can sense operating hydraulic pressure for example and when it drops off quickly due to getting through the tubular 10 it can trigger surface pumps (not shown) to immediately shut off so that the blades 18 immediately retract (due to a spring return or equivalent, not shown) and stop turning or rapidly slow down while retracting.

In another variation, the cutting does not have to be mechanical with cutters or blades. The cutting can be by hydraulic jet under high pressure and the sleeve 14 can be thick enough or hard enough to resist getting cut through long enough to be able to sense the condition and have the pumps shut off by surface personnel or automatically. The fluid jets may need to be turned from a radial orientation so that on engagement with the sleeve 14 they impart a spin to it rather than trying to continue cutting through it radially. Another variation is to use lasers or other energy forms that can cut through the tubular 10 rapidly but that will not go through a sleeve 14 as rapidly or at all such as by adding a reflective or mirror coating internally of the sleeve 14. The sleeve can also have a coating or other material on its inside surface to prevent it from getting cut though.

The above description is illustrative of the preferred embodiment and many modifications may be made by those skilled in the art without departing from the invention whose scope is to be determined from the literal and equivalent scope of the claims below.

We claim:

1. A method of protecting structures in subterranean formations extending from a surface and disposed adjacent an outside wall of a tubular being cut through, comprising:

providing a gap at a cut location between the outer surface of a tubular to be cut with a cutter and an adjacent structure;

inserting a single cutting device in the tubular whose maximum extended cutting reach is at least to said adjacent structure;

cutting through said tubular and into said gap; and mechanically preventing said cutting device from further cutting in said gap before said adjacent structure is cut with a structure separate from a dimension of the cutting device that determines said cutting reach.

2. The method of claim 1, comprising:

locating said gap in an outer wall of said tubular.

3. A method of protecting structures in subterranean formations extending from a surface and disposed adjacent an outside wall of a tubular being cut through, comprising:

providing a gap at a cut location between the outer surface of a tubular to be cut with a cutter and an adjacent structure;

inserting a single cutting device in the tubular whose maximum extended cutting reach is at least to said adjacent structure;

cutting through said tubular and into said gap; and mechanically preventing said cutting device from further cutting in said gap before said adjacent structure is cut;

locating said gap in an outer wall of said tubular;

locating a member around said tubular in said gap, said member originally loose or becoming loose on contact with said cutting device.

4. The method of claim 3, comprising:

fitting a rotatably mounted sleeve in said gap as said loosely mounted member using said tubular member as a mandrel for a packer.

5. The method of claim 4, comprising:

fitting at least one bearing on said sleeve.

6. The method of claim 4, comprising:

providing lubricant between said sleeve and said tubular in said gap.

7. The method of claim 4, comprising:

making said sleeve one of; seamless, with a seam, rolled as a scroll, without wall penetrations and with wall penetrations.

8. The method of claim 4, comprising:

sensing a load change on said cutting device at the surface;

shutting off said cutting device responsive to said load change.

9. The method of claim 8, comprising:

detecting a pressure drop in hydraulic pressure delivered to the cutting device;

automatically shutting off a pump that supplies said cutting device in response to the detected pressure signal.

10. The method of claim 4, comprising:

using an underreamer to make the cut in the tubular.

11. The method of claim 4, comprising:

using a laser as said cutting device;

configuring said sleeve to avoid being penetrated by said laser.

12. The method of claim 3, comprising:

using a fluid pressure delivered through nozzles as said cutter;

imparting movement on said loosely mounted member with a stream from said nozzles.

13. A method of protecting structures in subterranean formations extending from a surface and disposed adjacent an outside wall of a tubular being cut through, comprising:

providing a gap at a cut location between the outer surface of a tubular to be cut with a cutter and an adjacent structure;

inserting a single cutting device in the tubular whose maximum extended cutting reach is at least to said adjacent structure;

cutting through said tubular and into said gap; and preventing said cutting device from further cutting in said gap before said adjacent structure is cut;

locating said gap in an outer wall of said tubular;

locating a member around said tubular in said gap, said member originally loose or becoming loose on contact with said cutting device;

fitting a rotatably mounted sleeve in said gap as said loosely mounted member using said tubular member as a mandrel for a packer;

engaging said sleeve with said cutting device spinning said sleeve with said cutting device to prevent further cutting by said cutter.

14. A method of protecting structures in subterranean formations extending from a surface and disposed adjacent an outside wall of a tubular being cut through, comprising:

providing a gap at a cut location between the outer surface of a tubular to be cut with a cutter and an adjacent structure;

inserting a single cutting device in the tubular whose maximum extended cutting reach is at least to said adjacent structure;

cutting through said tubular and into said gap; and preventing said cutting device from further cutting in said gap before said adjacent structure is cut;

supporting a rotatably mounted member outside and around said tubular to create said gap;

spinning said member with said cutting device after cutting through the wall of said tubular member.

15. The method of claim 14, comprising:

fitting a sleeve in said gap as said rotatably mounted member.

16. The method of claim 15, comprising:

fitting at least one bearing on said sleeve or providing lubricant between said sleeve and said tubular in said gap.

17. The method of claim 16, comprising:

making said sleeve one of: seamless, with a seam, rolled as a scroll, without wall penetrations and with wall penetrations.

18. The method of claim 17, comprising:

using an underreamer to make the cut in the tubular.

19. A method of protecting structures in subterranean formations extending from a surface and disposed adjacent an outside wall of a tubular being cut through, comprising:

providing a gap at a cut location between the outer surface of a tubular to be cut with a cutter and an adjacent structure;

inserting a single cutting device in the tubular whose maximum extended cutting reach is at least to said adjacent structure;

cutting through said tubular and into said gap; and mechanically preventing said cutting device from further cutting in said gap before said adjacent structure is cut with a structure separate from a dimension of the cutting device that determines said cutting reach;

sensing a load change on said cutting device at the surface;

shutting said cutting device responsive to said load change.

20. A packer assembly for downhole use, comprising:

a mandrel supporting slips and a sealing element and an external structure adjacent said mandrel;

said slips releasable from a set position by cutting through said mandrel in a predetermined cut location with a cutter assembly;

a rotatably mounted movable member around said mandrel at said cut location to be engaged by operation of said cutter assembly when said mandrel is cut through to prevent damage to said external structure.

* * * * *